US007992351B1

(12) United States Patent
Kramer

(10) Patent No.: US 7,992,351 B1
(45) Date of Patent: Aug. 9, 2011

(54) PROTECTIVE CANOPY

(76) Inventor: James J Kramer, Goodyear, AZ (US)

( * ) Notice: Subject to any disclaimer, the term of this patent is extended or adjusted under 35 U.S.C. 154(b) by 458 days.

(21) Appl. No.: 12/016,199

(22) Filed: Jan. 17, 2008

(51) Int. Cl.
*E04B 7/16* (2006.01)

(52) U.S. Cl. ..... 52/74; 52/68; 52/69; 52/71; 52/72

(58) Field of Classification Search ..... 52/74, 68, 52/65, 69, 71, 72
See application file for complete search history.

(56) References Cited

U.S. PATENT DOCUMENTS

| | | | | |
|---|---|---|---|---|
| 2,795,826 | A * | 6/1957 | Turteltaub | 52/74 |
| 2,848,765 | A * | 8/1958 | Showalter | 52/74 |
| 3,078,117 | A * | 2/1963 | Martini | 296/173 |
| 3,134,426 | A * | 5/1964 | Cherubin | 160/81 |
| 3,149,381 | A * | 9/1964 | Santo | 49/71 |
| 3,286,413 | A * | 11/1966 | Wells | 52/16 |
| 4,971,129 | A * | 11/1990 | Townend | 160/213 |
| 5,560,383 | A * | 10/1996 | Fuller | 135/88.01 |
| 5,697,320 | A * | 12/1997 | Murray | 114/361 |
| 6,085,861 | A * | 7/2000 | Jines | 181/30 |
| 6,421,966 | B1 * | 7/2002 | Braunstein et al. | 52/173.3 |
| 6,494,246 | B1 * | 12/2002 | Blevins | 160/67 |
| 6,752,193 | B1 * | 6/2004 | Molloy | 160/67 |
| 6,918,160 | B1 * | 7/2005 | Clark | 16/370 |
| 6,948,758 | B2 * | 9/2005 | Henderson | 296/100.06 |
| 2005/0280278 | A1 * | 12/2005 | Henderson | 296/100.06 |

* cited by examiner

*Primary Examiner* — Richard E Chilcot, Jr.
*Assistant Examiner* — Mark R Wendell
(74) *Attorney, Agent, or Firm* — Michael D. Eisenberg

(57) ABSTRACT

An apparatus for protecting susceptible objects comprises a bracket having a pin receiving portion and hinge portion. The apparatus also includes a cover pivotally connected to the hinge portion of the bracket wherein the bracket is securable to a wall and the cover is pivotable over a susceptible asset to protect the object from harmful forces.

14 Claims, 12 Drawing Sheets

PROTECTIVE CANOPY

TECHNICAL FIELD

The present invention relates to a protective canopy or cover for shielding and protecting outdoor equipment or sensitive objects.

BACKGROUND OF THE INVENTION

The subject invention generally relates to a protective canopy or cover for shielding and protecting outdoor machinery or objects which may be susceptible to outside forces.

BRIEF SUMMARY OF EMBODIMENTS OF THE INVENTION

Some embodiments of the invention relate to an apparatus for protecting susceptible objects, for example, an outdoor equipment canopy or cover. According to one embodiment of the invention, the apparatus has a bracket having a pin receiving portion and a hinge portion. A cover is pivotally connected to the hinge portion of the bracket. The bracket is securable to a wall and the cover is pivotable over a susceptible tangible asset, such as outdoor pool machinery for example, to protect the asset from harmful forces, such as weather.

In another embodiment, the apparatus for protecting susceptible objects may further comprises a pin receivable into the pin receiving portion of the bracket.

In a further embodiment, the apparatus for protecting susceptible objects, may comprise a brace that is connectable to the bracket and configured to hold the cover between the brace and the bracket. In one embodiment, the brace is connected to the pin.

In yet another embodiment, the cover may include a frame having a side member. The brace has a first end and a second end. The first end may be connected to the pin and the second end may comprise a loop configured to receive an end of the pin. The brace may be configured to hold the side member between brace and the bracket.

In still another embodiment of the apparatus for protecting susceptible objects, the brace is manually releasable from the pin.

In another embodiment, the cover may include a slot for receiving a stand. When the cover is connected to a stand, the stand supports the cover over the susceptible tangible asset.

In a further embodiment of the apparatus for protecting susceptible objects, the cover may include a frame having a front member and the slot may be pivotally connected to the front member.

In yet another embodiment, the apparatus may include a stand, wherein when the cover is supported by the stand the stand supports the cover over the susceptible tangible asset. In one embodiment, the stand may be anchored to the ground.

In still a further embodiment of the apparatus for protecting susceptible objects, the cover is convertible between an up position and a down position.

In another embodiment of the apparatus for protecting susceptible objects, the cover may comprise a frame and a surface that connects to and extends between the frame wherein the frame comprises the outside edge of the surface.

In a further embodiment, the apparatus may include two brackets securable to a wall, with each bracket configured to connect to a frame of the cover.

In yet another embodiment, a method of protecting objects may comprise: securing a bracket to a wall; pivotally connecting a cover to the bracket; connecting a brace to the bracket; and holding the cover between the brace and the bracket so that the cover is positioned in an up position.

In still a further embodiment of the method for protecting objects, the brace may be connected to a pin that is connected to the bracket.

In another embodiment, the method may include inserting a pin into the brace to hold the cover in the up position.

In a further embodiment, the method may include releasing the pin from the brace and converting the cover to a down position.

In yet another embodiment, a protective canopy for protecting objects from harmful elements is provided. The protective canopy includes a bracket having a pin receiving portion and a hinge portion. The pin receiving portion has a first through hole for receiving a pin. The hinge portion is spaced apart from the pin receiving portion and is configured to pivotally connect a frame element to the bracket. A socket may be pivotally connected to the hinge portion of the bracket and a cover is connected to the socket. The protective canopy may include a pin that is receivable into the first through hole. A brace may be connected to the pin and has a loop disposed at an end of the brace. The loop can be configured to receive an end of the pin. The brace is configured to secure the cover to the bracket when the pin is received into the loop of the brace. The bracket is securable to a wall and the cover is convertible between an up position and a down position over objects susceptible to harmful forces.

In still a further embodiment, the apparatus for protecting susceptible objects may further comprise second and third through holes for securing the bracket to a surface. The second through hole may be disposed above the pin receiving portion and the third through hole may be disposed below the hinge portion so that the pin receiving and hinge portions are disposed between the second and third through holes.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
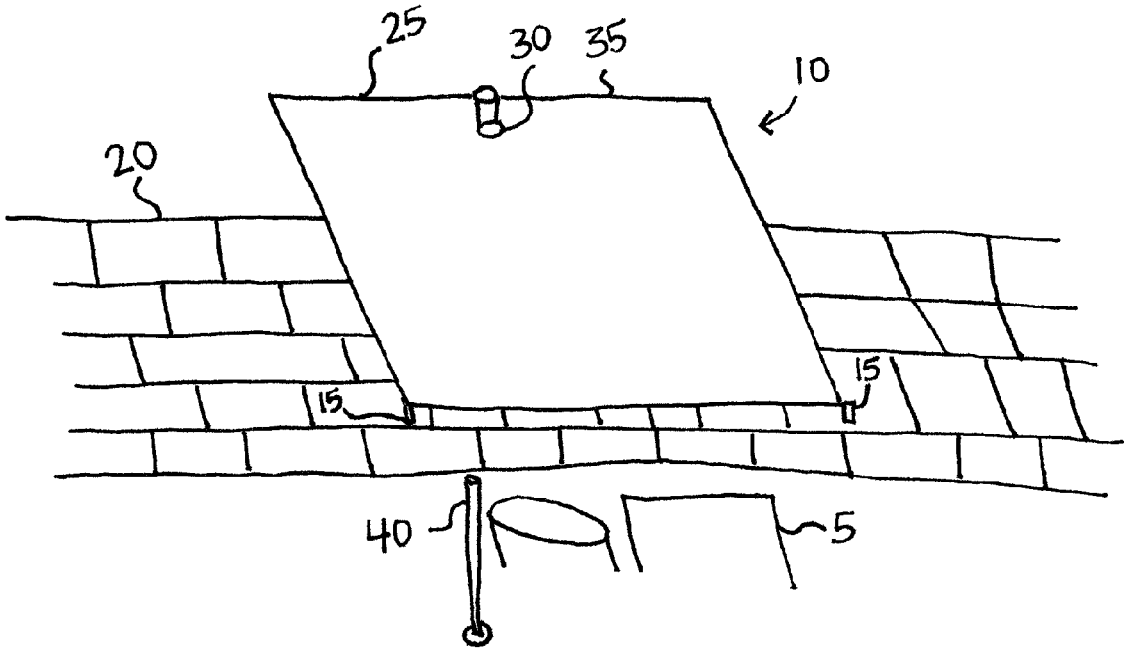
FIG. 1 is a perspective view of a preferred protective canopy in an up position.
Figure 2:
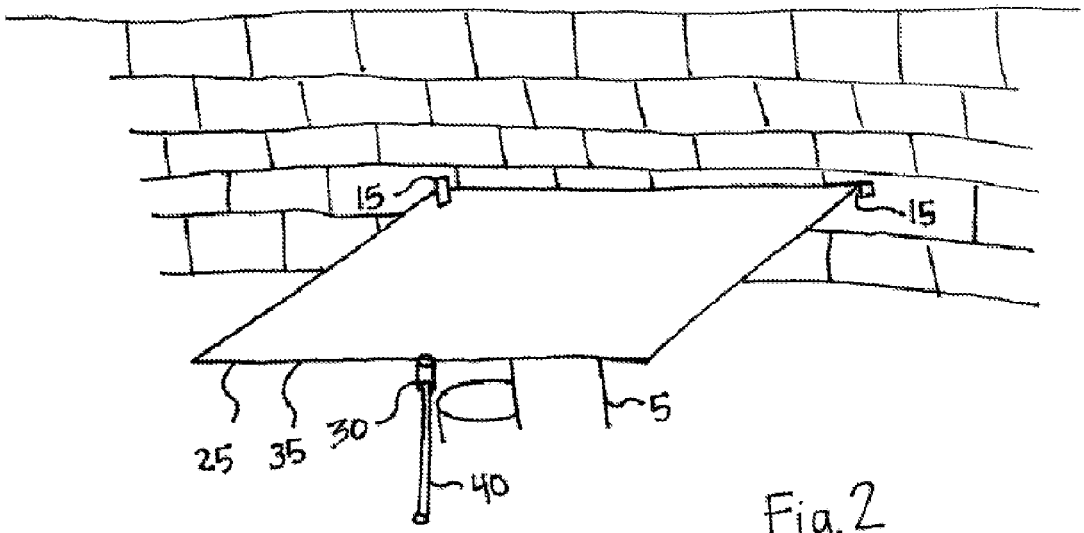
FIG. 2 is a perspective view of a preferred protective canopy in a down position.
Figure 3:
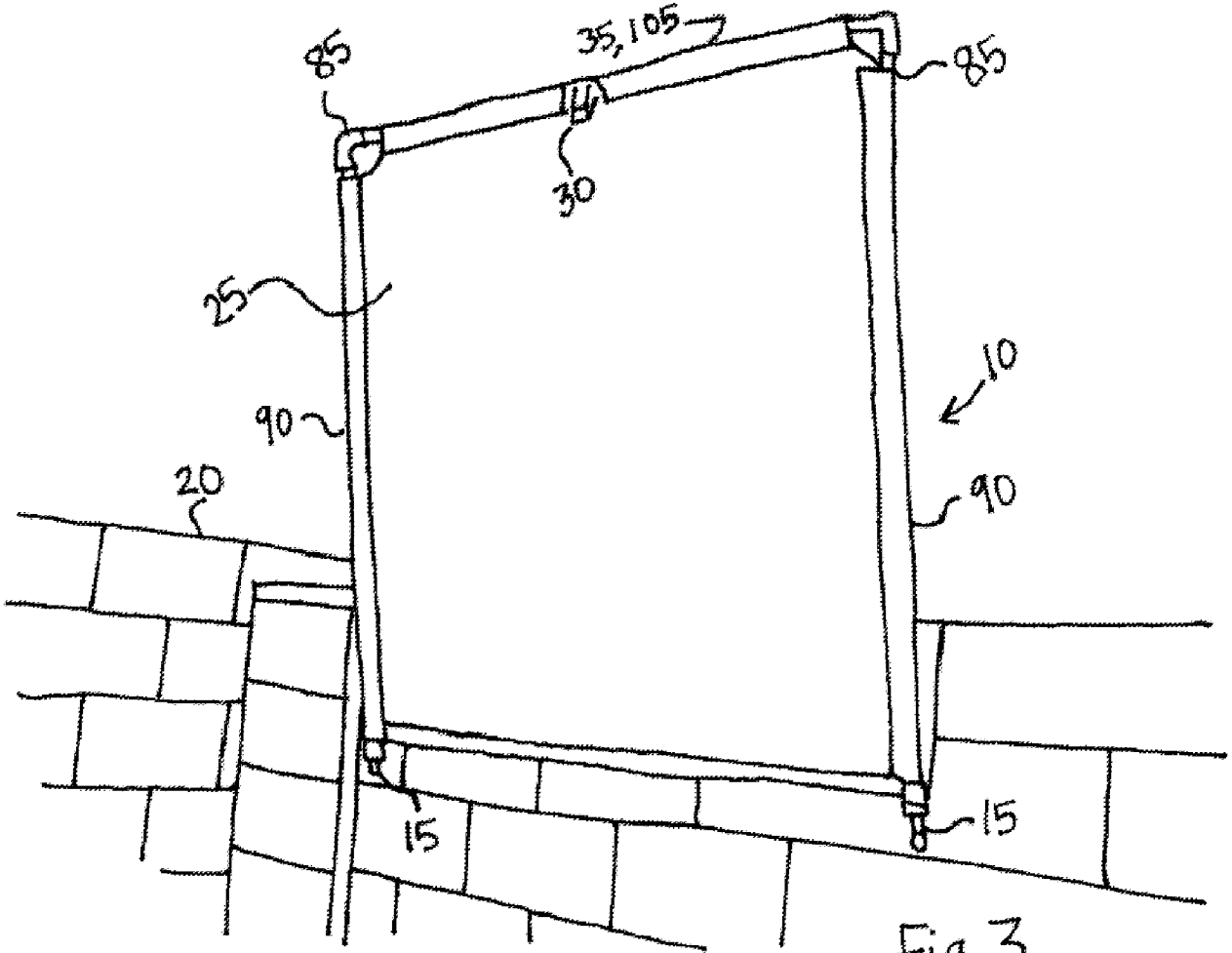
FIG. 3 is a perspective view of a preferred protective canopy in an up position.

The present invention is directed toward an apparatus for protecting susceptible objects 5, for example, an outdoor equipment canopy or cover. Referring to FIGS. 1, 2 and 3, according to one embodiment of the invention, the apparatus 10 includes a pair of brackets 15, or tandem hinges 15, that may be affixed to a wall 20. A canopy or cover 25 may be pivotally attached to the brackets 15 and a connector, which in one embodiment may be a slot 30, may be attached to the cover 25 along a front edge 35 of the cover 25. The slot 30 can connect to a stand 40 which may be supported by burying an end of the stand 40 into the ground and pouring concrete around the support if possible. FIGS. 1, 3, 5, 6, and 10 illustrate the apparatus 10 in an up position, secured to the bracket 15, from various views. FIGS. 2, 4, 8, and 9 illustrate the apparatus 10 in a down position, from various views.

Referring to FIGS. 4-7, the bracket 15 has a pin receiving portion 45 and a hinge 50 portion spaced apart from the pin receiving portion 45. In a preferred embodiment, the bracket 15 portions 45, 50 are shaped like humps that extend outward from the bracket 15, with the pin receiving hump 45 smaller than the hinge receiving hump 50. A cover 25 is pivotally connected to the hinge portion 50 of the bracket 15. The bracket 15 is securable to a wall and the cover is pivotable over a susceptible object 5, such as outdoor pool machinery 5 for example, to protect the object from harmful forces, such as weather. A pin 55 is receivable into the pin receiving portion 45 of the bracket 15 via a first through hole 60. The pin 60 is rotatable within the through hole 60. A brace 65 is connectable to the bracket 15 and configured to hold the cover 25 between the brace 65 and the bracket 15.

Figure 5:
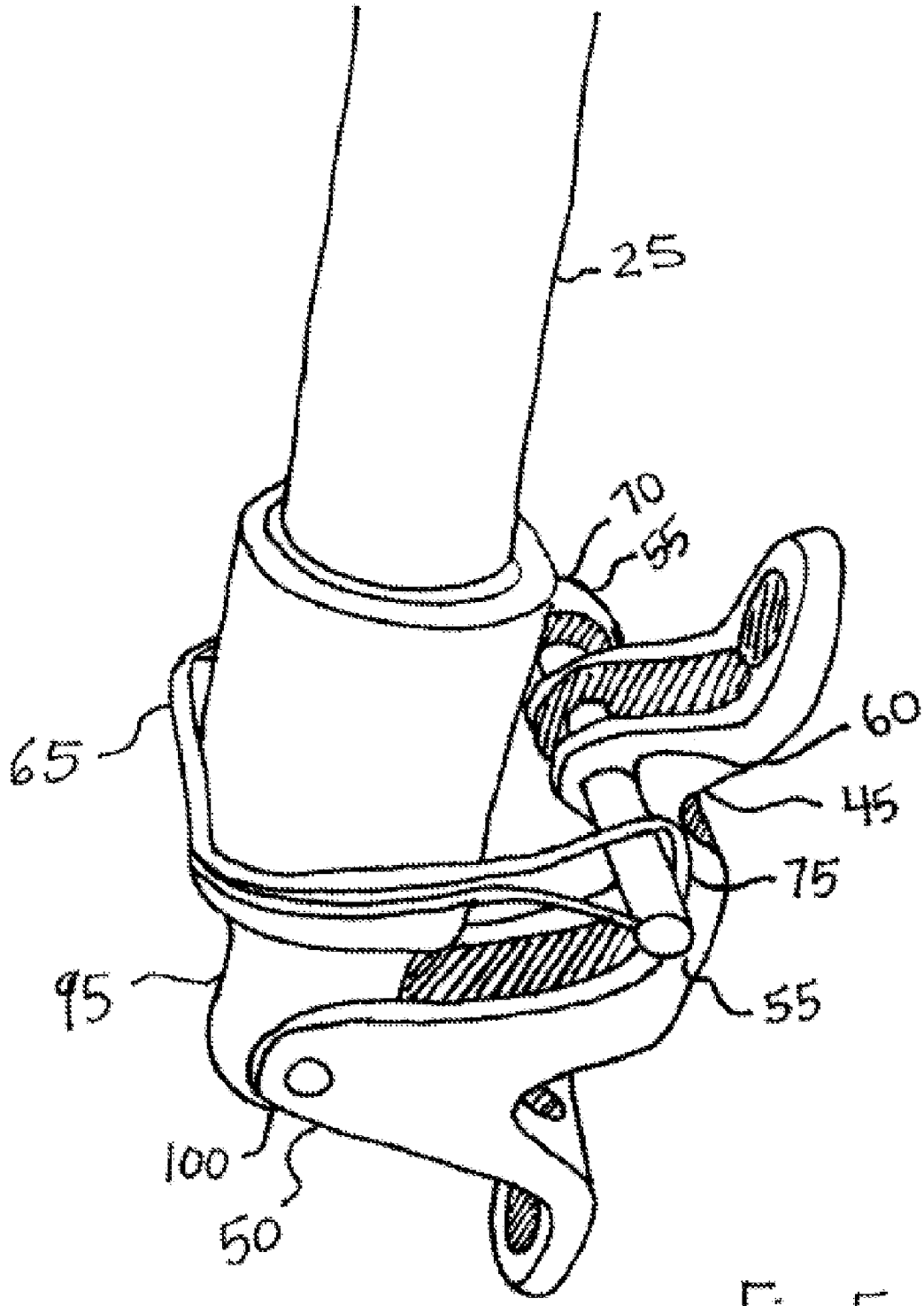
FIG. 5 is a right side perspective view illustrating a part of a cover braced to a bracket in accordance with the principles of the invention.
Figure 6:
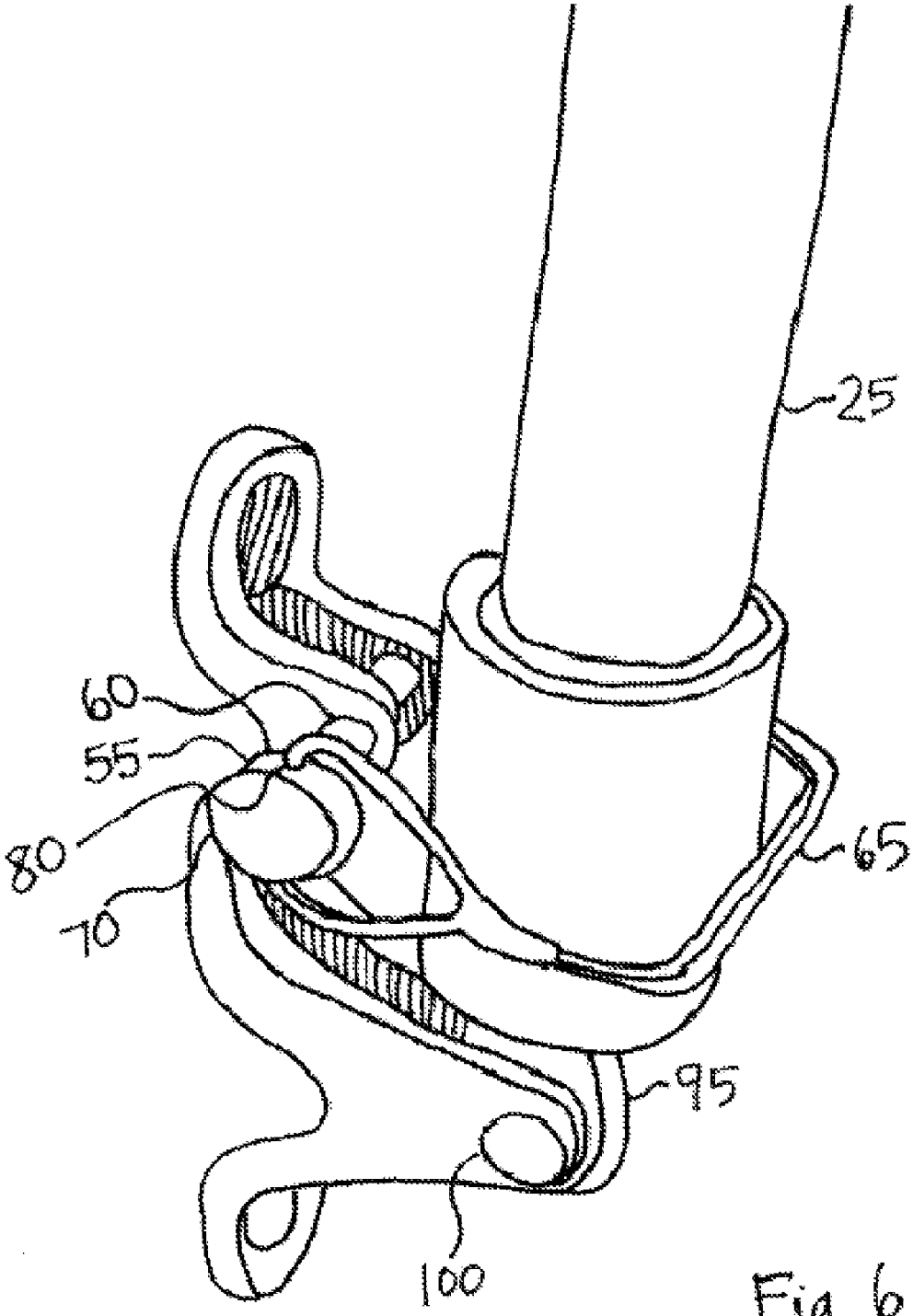
FIG. 6 is a left side perspective view illustrating a part of a cover braced to a bracket in accordance with the principles of the invention.

In one embodiment, the brace 65 is connected to a head 70 of the pin 60 and the brace 65 has a loop 75 at a second end of the brace 65 that is configured to receive an end of the pin 60. The brace is rotatable about the head 70 of the pin at a first end 80 and the brace may be sufficiently flexible so that it can be manually released from the pin. The brace is configured to hold the cover 25 between the brace 65 and the bracket 15 when the pin 55 is received in the loop 75 as illustrated in FIGS. 3, 5, and 6.

Figure 7:
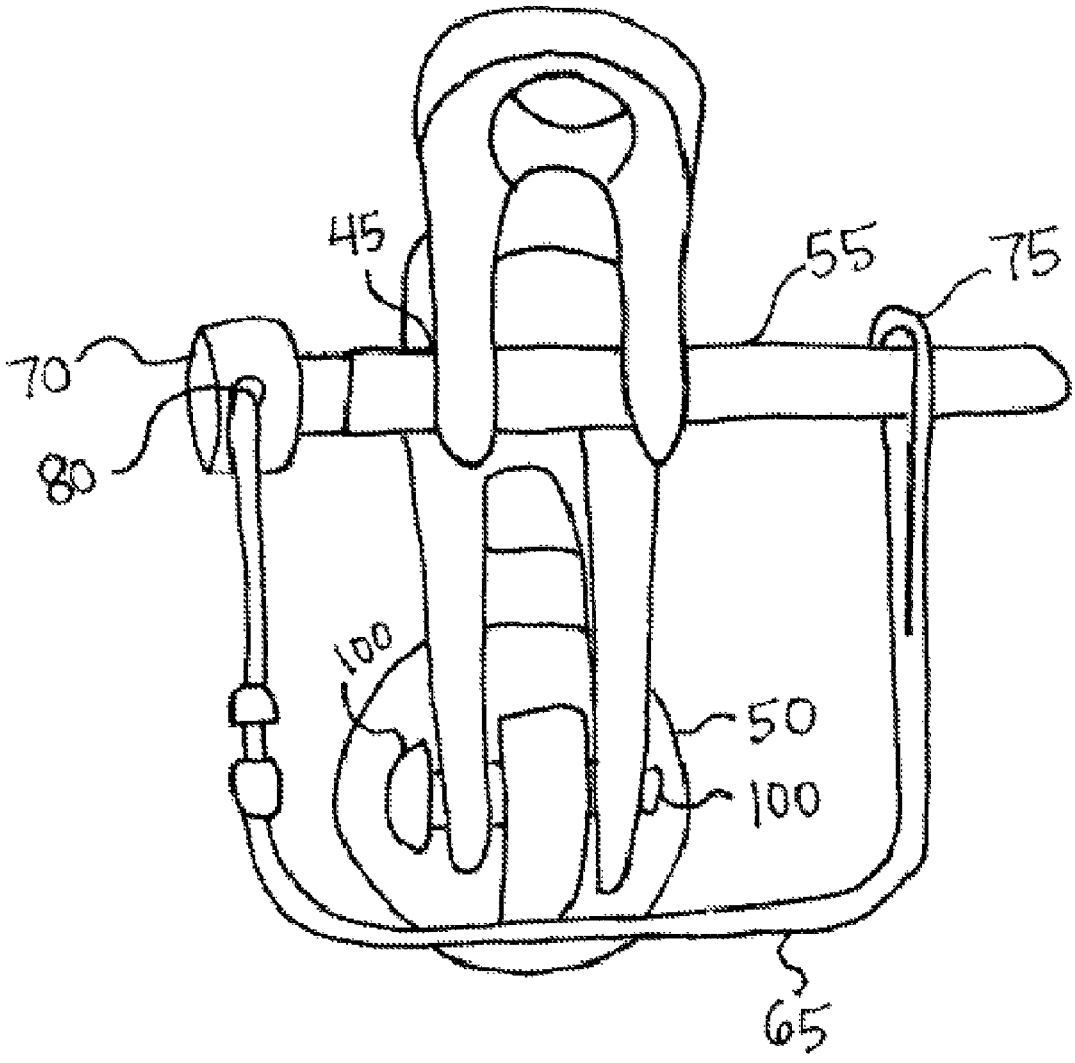
FIG. 7 is a top perspective view of a bracket.
Figure 8:
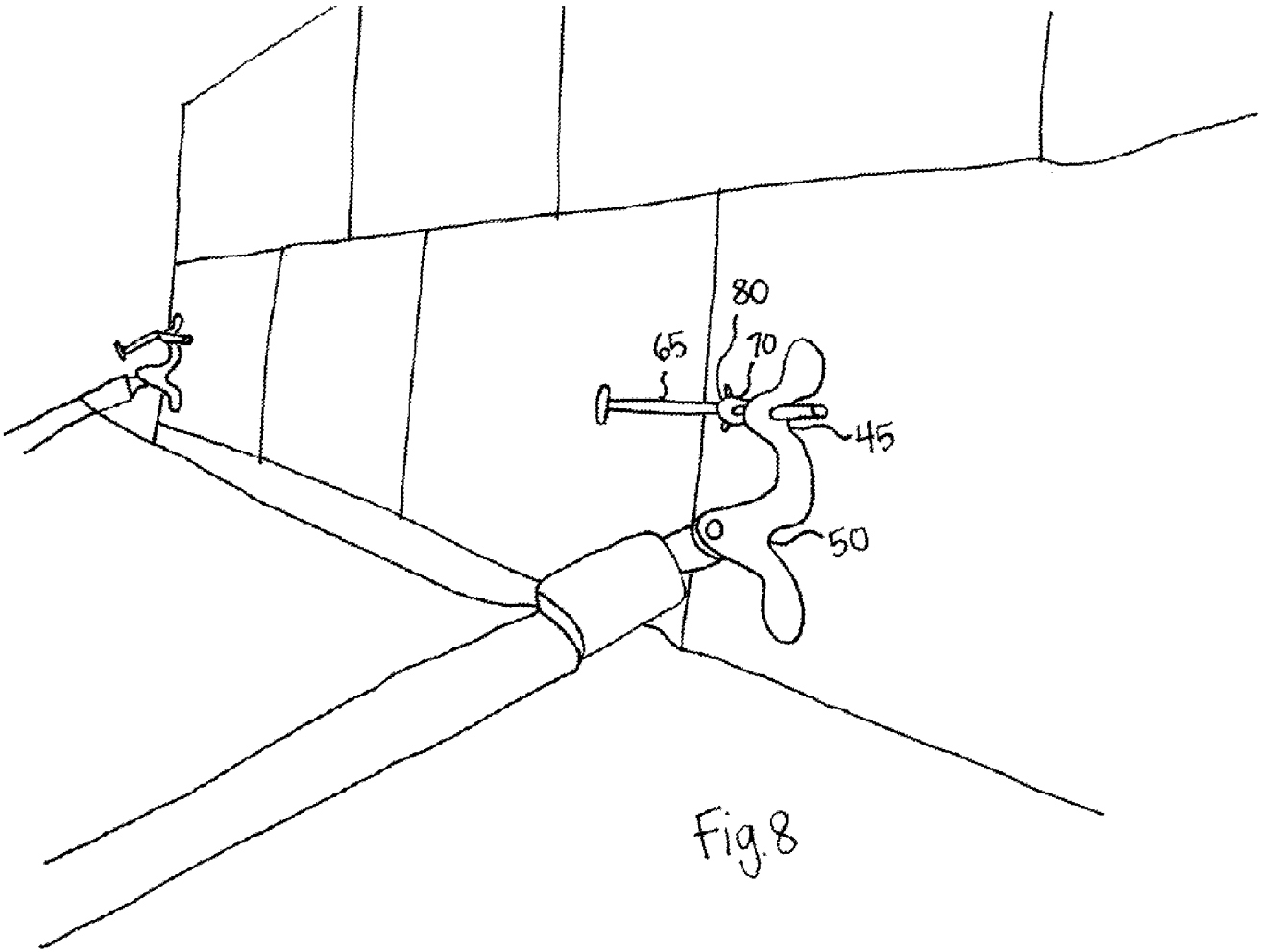
FIG. 8 is a perspective view illustrating a protective canopy in a down position and a brace in an open position.

Referring to FIGS. 3, 4, 7 and 9, in another embodiment, the cover 25 may include a frame 85 having side members 90. The frame 85 supports a canopy, which may be cloth, nylon or any suitable material for blocking out or attenuating sunlight, rain or wind. In a preferred embodiment, the frame 85 may comprise piping having a one inch diameter and a 0.0625 inch wall thickness and comprised of 6061 aluminum. The side members 90 terminate and connect to an eye end 95 that connects to the hinge portion 50 of the bracket 15. A bolt 100 secures the eye end 95 to the hinge portion 50, as shown in FIG. 7, and is rotatable about the bolt 100.

In another embodiment, the cover may include a slot for receiving a stand. When the cover is connected to a stand, the stand supports the cover over the susceptible object.

Figure 9:
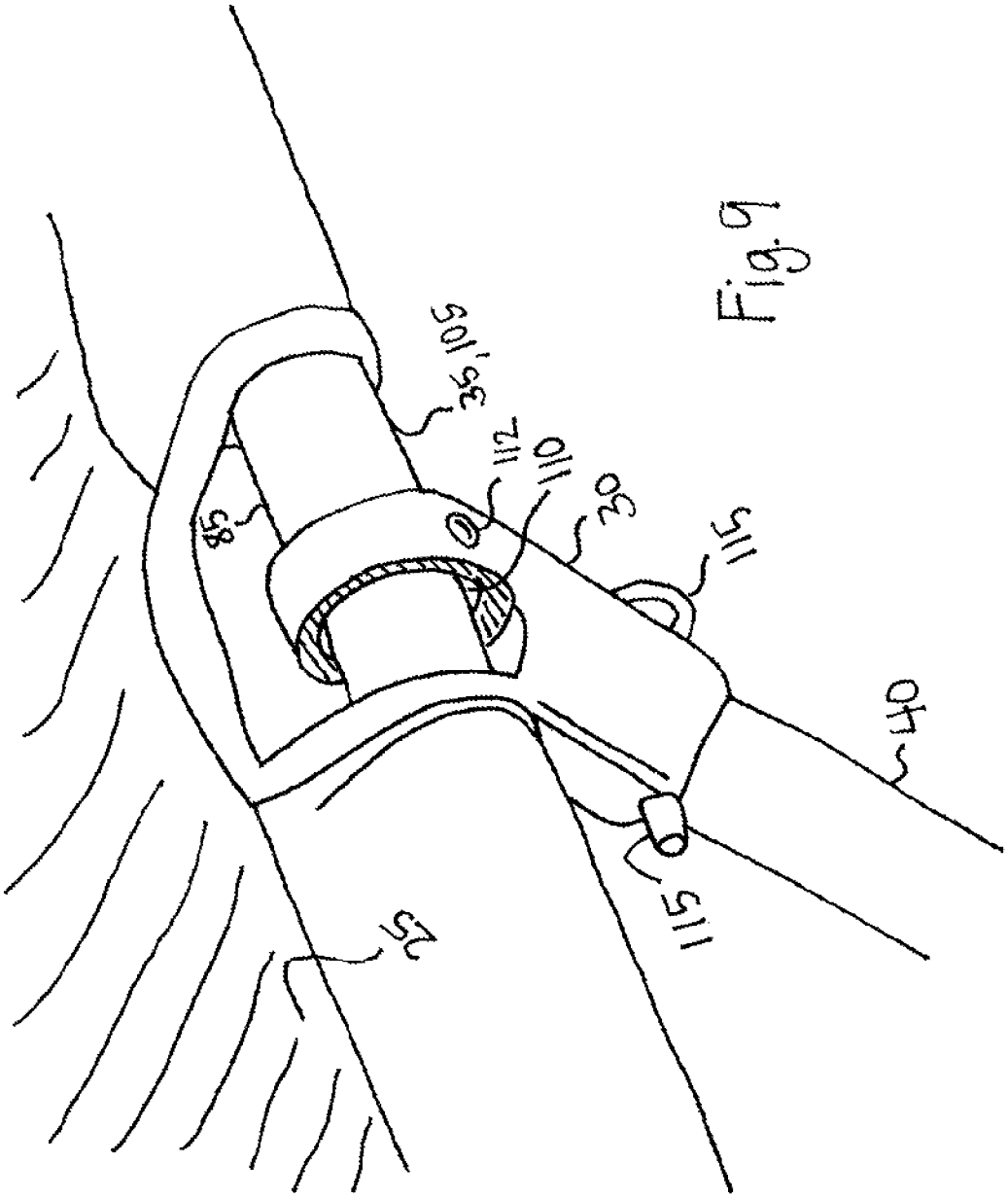
FIG. 9 is a perspective view illustrating the cover connected to stand via a slot.
Figure 10:
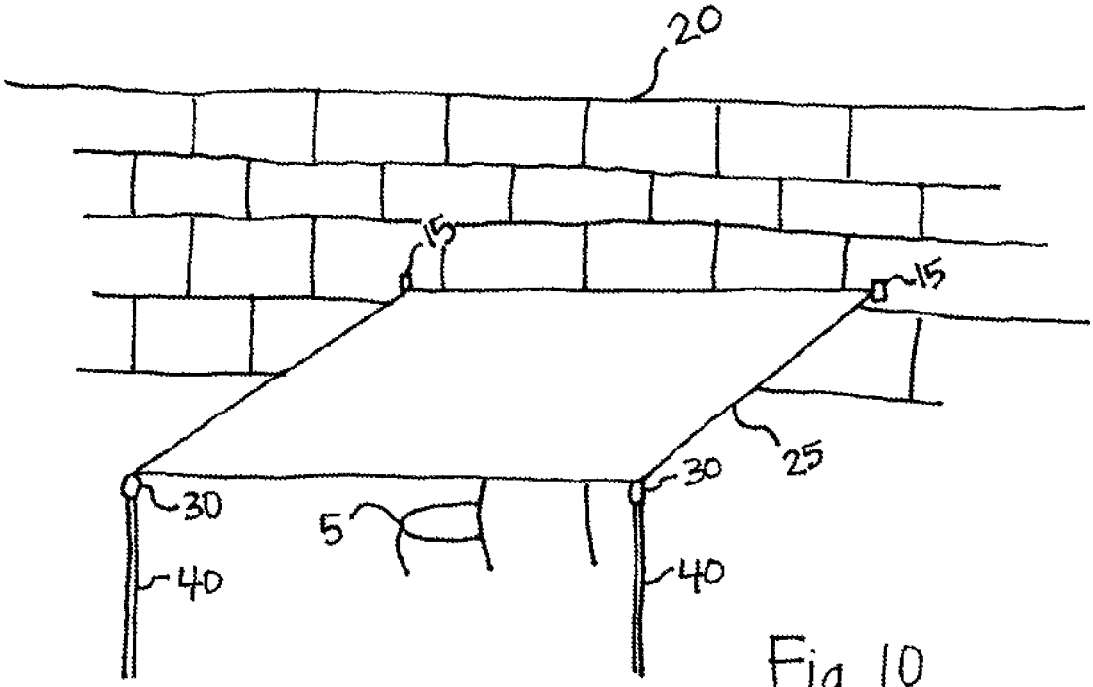
FIG. 10 is perspective view of an embodiment having two slots disposed at the sides of the canopy.

Referring to FIGS. 3 and 9, in a further embodiment of the apparatus for protecting susceptible objects, the cover 25 may include a frame 85 having a front member 105 and the slot 30 may be pivotally connected to a center of the front member 105. The slot is configured to receive an end of the stand 40. The slot 30 may include a through hole 110 through which the front member 105 may connect and permit the slot 30 rotate around for ease of connection to the stand 40 when the apparatus is converted from an up position to a down position. In a preferred embodiment, the slot 30 my comprise a single slip tee (upright slip tee) or a double slip tee (rafter slip tee—depicted) having a dent pin 115 for securing the slot 30 to the stand 40 and allowing for quick disconnect or reconnect of the slot 30 to the stand 40. A set screw 112 may be tightened to retain the configuration of the slot 30 and the frame 85 so that a user may pivot the cover up and down from the stand 40 without the need to reset the slot's 30 position. Referring to FIG. 10, in an alternative embodiment, the apparatus 10 has two slots 30 disposed near the corners of the cover 25 and are connectable to two stands 40 secured to the ground.

When the apparatus 10 is in the down position, the cover is supported by the stand and the stand supports the cover over the susceptible object 5. In one embodiment, the stand may be anchored to the ground via tent stakes.

Referring to FIG. 3, in another embodiment of the apparatus for protecting susceptible objects, the cover 25 may comprise a frame 85 and a surface that connects to and extends between the frame wherein the frame comprises the outside edges of the surface.

Referring again to FIG. 3, in a further embodiment, the apparatus may include two brackets 15 securable to a wall 20, with each bracket 15 configured to connect to a frame 85 of the cover 25.

Figure 11:
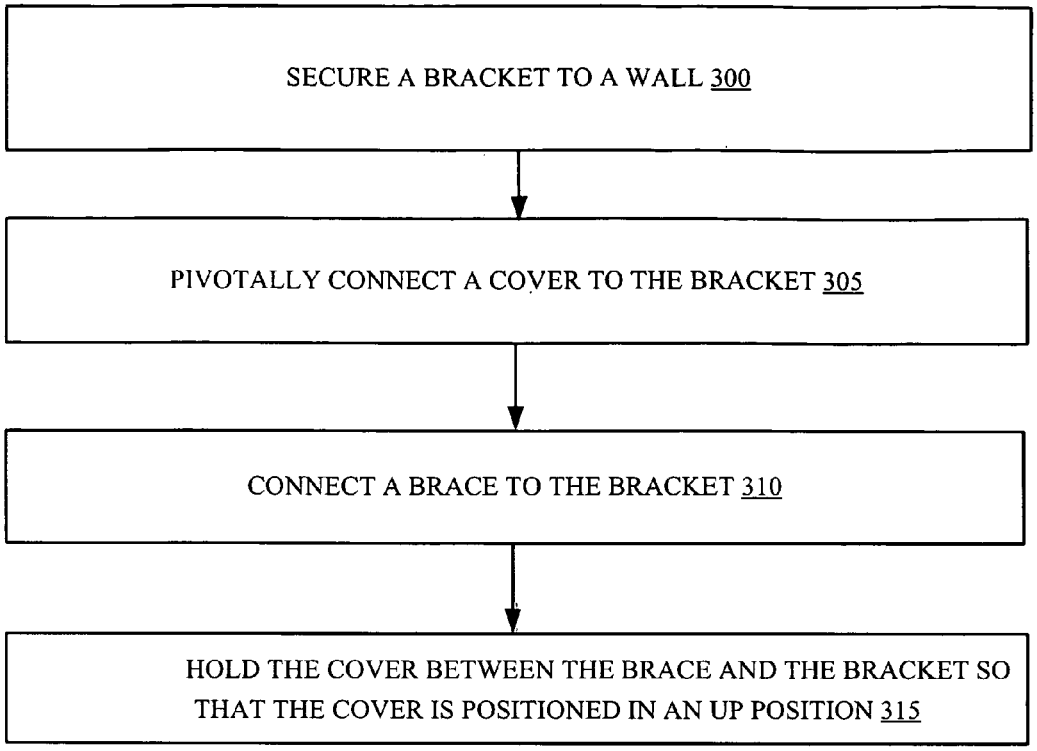
FIG. 11 is a flow chart illustrating a method of protecting objects.

In yet another embodiment, referring to FIG. 11, a method of protecting objects may be provided. In a step 300, the method may include securing a bracket to a wall. In a step 305, pivotally connecting a cover to the bracket. In a step 310, connecting a brace to the bracket. In a step 315, holding the cover between the brace and the bracket so that the cover is positioned in an up position.

In still a further embodiment of the method for protecting objects, the brace may be connected to a pin that is connected to the bracket.

Figure 12:
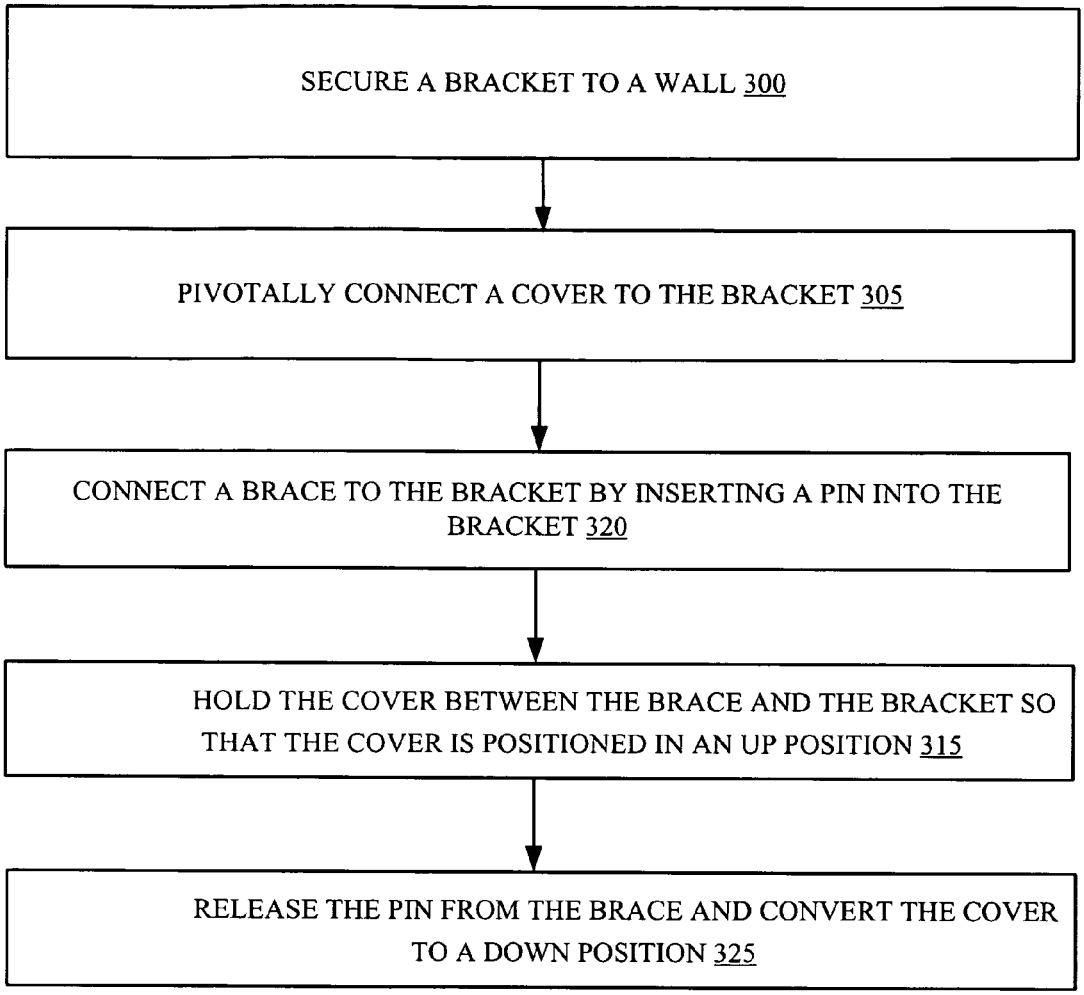
FIG. 12 is a flow chart of another method of protecting objects.

In another embodiment, referring to FIG. 12, the method the method may include a step 320 of inserting a pin into the brace to hold the cover in the up position. In a further embodiment, the method may include the step 325 of releasing the pin from the brace and converting the cover to a down position.

In yet another embodiment, a protective canopy for protecting objects from harmful elements is provided. The protective canopy includes a bracket having a pin receiving portion and a hinge portion. The pin receiving portion has a first through hole for receiving a pin. The hinge portion is spaced apart from the pin receiving portion and is configured to pivotally connect a frame element to the bracket. A socket may be pivotally connected to the hinge portion of the bracket and a cover is connected to the socket. The protective canopy may include a pin that is receivable into the first through hole. A brace may be connected to the pin and has a loop disposed at an end of the brace. The loop can be configured to receive an end of the pin. The brace is configured to secure the cover to the bracket when the pin is received into the loop of the brace. The bracket is securable to a wall and the cover is convertible between an up position and a down position over objects susceptible to harmful forces.

Figure 4:
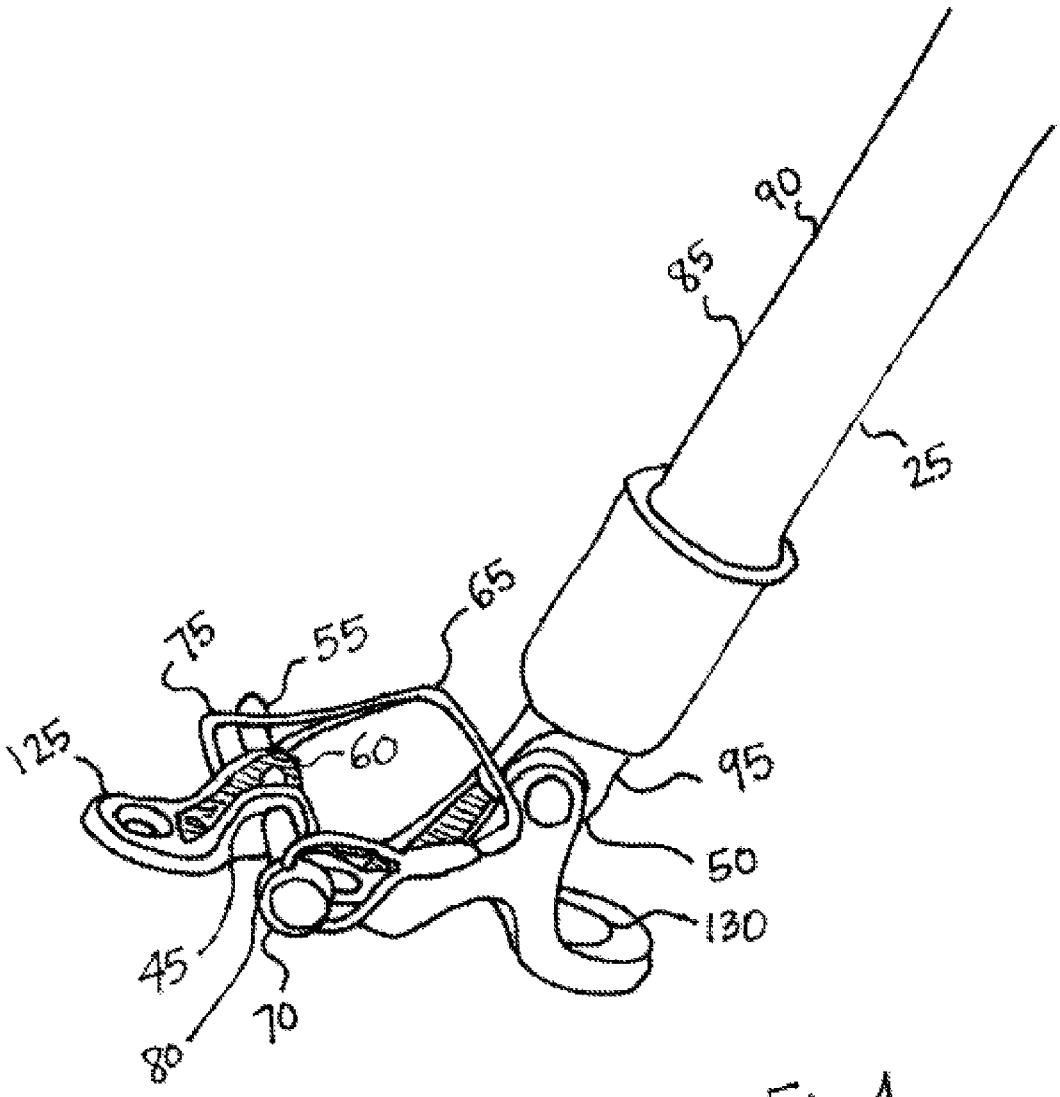
FIG. 4 is a perspective view of a bracket in accordance with the principles of the invention.

In still a further embodiment, referring to FIG. 4, the apparatus for protecting susceptible objects may further comprise second 125 and third 130 through holes for securing the bracket to a surface. The second through hole 125 may be disposed above the pin receiving portion and the third through hole 135 may be disposed below the hinge portion so that the pin receiving and hinge portions are disposed between the second 125 and third 130 through holes.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. An apparatus for protecting susceptible objects, comprising:

a bracket having a pin receiving portion and hinge portion;

a brace configured to hold the cover between the brace and the bracket, the brace connectable to the bracket;

a cover pivotally connected directly to the hinge portion of the bracket;

wherein the bracket is securable to a wall and the cover is pivotable over a susceptible tangible asset to protect the asset from harmful forces; and wherein the apparatus further comprises a stand, wherein when the cover is supported by the stand the stand supports the cover over the susceptible tangible asset.

2. The apparatus for protecting susceptible objects of claim 1, further comprising a pin receivable into the pin receiving portion of the bracket.

3. The apparatus for protecting susceptible objects of claim 2, wherein the brace is flexible.

4. The apparatus for protecting susceptible objects of claim 3, wherein the brace is connected to the pin.

5. The apparatus for protecting susceptible objects of claim 4, wherein the cover comprises a frame having a side member; and the brace has a first end and a second end, the first end connected to the pin and the second end comprising a loop configured to receive an end of the pin, the brace configured to hold the side member between brace and the bracket.

6. The apparatus for protecting susceptible objects of claim 5, wherein in the brace is manually releasable from the pin.

7. The apparatus for protecting susceptible objects of claim 1, wherein the cover comprises a slot for receiving a stand, wherein when the cover is connected to a stand, the stand supports the cover over the susceptible tangible asset.

8. The apparatus for protecting susceptible objects of claim 7, wherein the cover comprises a frame having a front member, the slot pivotally connected to the front member.

9. The apparatus for protecting susceptible objects of claim 1, wherein the stand is anchored to the ground.

10. The apparatus for protecting susceptible objects of claim 1, wherein the cover is convertible between an up position and a down position.

11. The apparatus for protecting susceptible objects of claim 1, wherein the cover comprises a frame and a surface connected to and extending between the frame wherein the frame comprises the outside edge of the surface.

12. The apparatus for protecting susceptible objects of claim 1, wherein the apparatus comprises two brackets securable to a wall, each bracket configured to connect to a frame of the cover.

13. A protective canopy for protecting objects from harmful elements comprising:

a bracket comprising:

a pin receiving portion having a first through hole for receiving a pin;

a hinge portion spaced apart from the pin receiving portion and configured to pivotally connect a frame element to the bracket;

a socket pivotally connected directly to the hinge portion of the bracket; and a cover comprising the frame element having at least two side members and a surface that connects to and extends between the side members wherein the side members comprise the outside edges of the surface;

a pin receivable into the first through hole;

a brace connected to the pin and having a loop disposed at an end of the brace, the loop configured to receive an end of the pin, the brace configured to secure the canopy to the bracket when the pin is received into the loop of the brace;

wherein the bracket is securable to a wall, the cover is connected to the socket and the canopy is convertible between an up position and a down position over objects susceptible to harmful forces; and wherein the apparatus further comprises a stand, wherein when the cover is supported by the stand the stand supports the cover over the susceptible tangible asset.

14. The apparatus for protecting susceptible objects of claim 13, further comprising second and third through holes for securing the bracket to a surface, the second through hole disposed above the pin receiving portion and the third through hole disposed below the hinge portion so that the pin receiving and hinge portions are disposed between the second and third through holes.

* * * * *